US005498350A

United States Patent [19]

Sakata et al.

[11] Patent Number: 5,498,350

[45] Date of Patent: Mar. 12, 1996

[54] LIQUID SOFTENER COMPOSITION

[75] Inventors: Yushi Sakata; Yumiko Tamura; Junichi Inokoshi, all of Wakayama, Japan

[73] Assignee: Kao Corporation, Tokyo, Japan

[21] Appl. No.: 374,507

[22] PCT Filed: Jun. 16, 1994

[86] PCT No.: PCT/JP94/00977

§ 371 Date: Jan. 13, 1995

§ 102(e) Date: Jan. 13, 1995

[87] PCT Pub. No.: WO95/00614

PCT Pub. Date: Jan. 5, 1995

[30] Foreign Application Priority Data

Jun. 18, 1993 [JP] Japan ..... 5-147506

[51] Int. Cl.[6] ..... D06M 13/144

[52] U.S. Cl. ..... 252/8.6; 252/8.7; 252/8.75; 252/8.8; 252/8.9

[58] Field of Search ..... 252/8.6, 8.8, 8.7, 252/8.75, 8.9

[56] References Cited

U.S. PATENT DOCUMENTS

| | | | |
|---|---|---|---|
| 3,472,840 | 10/1969 | Stone et al. | 536/43 |
| 4,126,562 | 11/1978 | Goffinet et al. | 252/8.8 |
| 4,128,484 | 12/1978 | Barford et al. | 252/8.8 |
| 4,179,382 | 12/1979 | Rudkin et al. | 252/8.8 |
| 4,237,016 | 12/1980 | Rudkin et al. | 252/8.8 |
| 4,661,267 | 4/1987 | Dekker et al. | 252/8.8 |
| 5,057,311 | 10/1991 | Kamegai et al. | 424/70 |
| 5,332,513 | 7/1994 | Doms et al. | 252/8.6 |

FOREIGN PATENT DOCUMENTS

| | | |
|---|---|---|
| 220156 | 4/1987 | European Pat. Off. . |
| 316996 | 5/1989 | European Pat. Off. . |
| 337354 | 10/1989 | European Pat. Off. . |
| 530959 | 3/1993 | European Pat. Off. . |
| 2387031 | 11/1978 | France . |
| 1593657 | 9/1966 | Germany . |
| 53-90368 | 8/1978 | Japan . |
| 56-62801 | 5/1981 | Japan . |
| 63-295764 | 12/1988 | Japan . |
| 1-168612 | 7/1989 | Japan . |
| 5-70501 | 3/1993 | Japan . |
| 2204608 | 9/1990 | United Kingdom . |
| 94/06900 | 3/1994 | WIPO . |

*Primary Examiner*—Anthony Green

*Attorney, Agent, or Firm*—Birch, Stewart, Kolasch & Birch

[57] ABSTRACT

A liquid softener composition comprising a polyhydric alcohol ester (A) represented by the following formula (I) and a cationized cellulose (B) having a nitrogen content determined by the Kjeldahl method of from 0.1 to 4% by weight, wherein the weight ratio of (B) to (A) ranges from 0.01 to 0.5 and the total content of (A) and (B) ranges from 1 to 30% by weight based on the total weight of the composition:

$$G[-OH]_p[-(OA)_mOH]_q[-\overset{\overset{\displaystyle O}{\|}}{O}CR]_r[-(OA)_nO\overset{\overset{\displaystyle O}{\|}}{C}R]_s \quad (I)$$

wherein:

G represents a residue obtained by removing all of the alcoholic hydroxyl groups from a polyhydric alcohol;

the $[-OH]$, $[-(OA)_mOH]$, $[-\overset{\overset{\displaystyle O}{\|}}{O}CR]$ and $[-(OA)_nO\overset{\overset{\displaystyle O}{\|}}{C}R]$ groups each bind to G at the site of a removed alcoholic hydroxyl group, wherein A represents an alkylene group having 2 or 3 carbon atoms, each alkylene group may be the same or different from one another, R represents a linear or branched alkyl or alkenyl group having from 7 to 23 carbon atoms, each alkyl or alkenyl group may be the same or different from one another, and m and n are each a number of from 0 to 100; and p, q, r and s represent each a number of 0 or above with the provisos that p+q+r+s represents the total number of the alcoholic hydroxyl groups in the starting polyhydric alcohol, and that neither p+q nor r+s equals 0.

20 Claims, No Drawings

LIQUID SOFTENER COMPOSITION

BACKGROUND OF THE INVENTION

FIELD OF THE INVENTION

The present invention relates to a liquid softener composition for clothes which can impart an excellent softness and antistatic properties to various fibers.

DESCRIPTION OF THE RELATED ART

During repeated wear and laundering, fiber-treatments are washed away from clothes, or fibers become hardened due to the deterioration of the fibers per se, which results in undesirable changes in the texture of the fibers or fabric. In recent years, therefore, softeners capable of imparting softness and antistatic properties to fibers have been widely used for domestic purposes.

Most of the household softeners marketed today comprise a cationic surfactant having 1 or 2 long-chain alkyl groups and a quaternary ammonium group per molecule (hereinafter referred to as a quaternary ammonium salt), in particular, a di(hardened beef tallow alkyl)dimethylammonium salt as the main component.

The softening effect of such a softener is exhibited by a decrease in the coefficient of friction on the surface of the fiber due to the lubricating effect of lipophilic sites in molecules of the base, i.e., the above-mentioned cationic surfactant, adsorbed on the surface of the fiber. However, it is unavoidable that a softener base having an excellent softening effect gives a sticky feeling, i.e., a so-called greasy feeling, to the clothes to be treated therewith. The extent of this greasy feeling varies depending on, for example, the type of fibers to be treated with the softener and the knitting technique. Generally, underwear such as plain-knitted cotton underwear and nylon tricot slip which is brought into direct contact with the skin, and towels with which the hands directly come into contact and of which the texture can be sensitively felt, are often evaluated as having a greasy feeling or an extremely oily feeling as a result of the softening treatment. When such a softener is used at a high concentration, this greasy feeling becomes more serious, though the softening effect is enhanced thereby. It has been therefore believed that the softening effect of the conventional softener compositions comprising a quaternary ammonium salt is correlated with this greasy feeling.

Under these circumstances, there have been proposed softener compositions containing a quaternary ammonium salt together with various additives, for example, a softener composition containing an acyclic quaternary ammonium salt, a specific poly-quaternary ammonium salt and a nonionic compound [see U.S. Pat. Nos. 4,126,562 (patented on Nov. 21, 1978; assignee: PROCTER AND GAMBLE CO) and 4,128,484 (patented on Dec. 5, 1978; assignee: PROCTER AND GAMBLE CO)]; a softener composition containing a quaternary ammonium salt, a cationic polyamide and a fatty acid glyceride [see GB Patent Publication-A No. 2,204,608 (published on Nov. 16, 1988)]; and a softener composition containing a quaternary ammonium salt, a fatty acid (salt) and glyceride [see Japanese Patent Publication-A No. 63-295,764 (published on Dec. 2, 1988)]. However, the present inventors have found that the above-mentioned problem of greasy feeling of the fibers or fabric resulting from using these softener compositions cannot be fully solved so long as they contain a quaternary ammonium salt as the effective component, even though various additives are employed therewith.

Accordingly, an object of the present invention is to provide a liquid softener composition to be used in a rinsing bath of a washing tub which can effectively impart a softness to both natural and synthetic fibers without giving any greasy feeling to the fibers to be treated therewith.

DISCLOSURE OF THE INVENTION

SUMMARY OF THE INVENTION

Under these circumstances, the present inventors have conducted extensive studies in order to solve the above-mentioned problem. As a result, they have found that the above-mentioned object can be achieved by using a combination of special components, thus completing the present invention.

Accordingly, the present invention provides a liquid softener composition, comprising:

(A) a polyhydric alcohol ester represented by the formula (I)

$$G[-OH]_p[-(OA)_mOH]_q[-\overset{O}{\overset{\|}{C}}OR]_r[-(OA)_n\overset{O}{\overset{\|}{C}}OR]_s \quad (I)$$

wherein

G represents a residue obtained by removing all of the alcoholic hydroxyl groups from a polyhydric alcohol;

the [—OH], [—$(OA)_m$OH], $$[-\overset{O}{\overset{\|}{C}}OR] \quad \text{and} \quad [-(OA)_n\overset{O}{\overset{\|}{C}}OR]$$

groups each bind to G at the site of a removed alcoholic hydroxyl group, wherein A represents an alkylene group having 2 or 3 carbon atoms, each alkylene group being the same or different from one another, R represents a linear or branched alkyl or alkenyl group having 7 to 23 carbon atoms, preferably a $C_{11}$, $C_{13}$, $C_{15}$ or $C_{17}$ alkyl group or a $C_{17}$ alkenyl group, each alkyl or alkenyl group being the same or different from one another, and m and n are each a number of from 0 to 100, preferably from 0 to 20; and p, q, r and s represent each a number of 0 or higher, with the provisos that p+q+r+s represents the total number of the alcoholic hydroxyl groups in the starting polyhydric alcohol, and that neither p+q nor r+s equals 0; and (B) a cationized cellulose having a nitrogen content of from 0.1 to 4% by weight, determined by the Kjeldahl method;

wherein the weight ratio of (B) to (A) ranges from 0.01 to 0.5 and the total content of (A) and (B) ranges from 1 to 30% by weight, based on the total weight of the composition.

As is apparent from the above description, component (A) is composed of G; [—OH] and/or (—$(OA)_m$OH]; and $$[-\overset{O}{\overset{\|}{C}}OR] \quad \text{and/or} \quad [-(OA)_n\overset{O}{\overset{\|}{C}}OR],$$

wherein G, A, R, m and n are each as defined above.

The component (A) may also be represented by the formula:

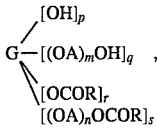

wherein G, A, R, m, n, p, q, r and s are each as defined above.

The component (A) has preferably 2 to 10, and still more preferably 3 to 6 alcoholic hydroxyl groups.

In other words, the present invention relates to a liquid softener composition which comprises the following components (A) and (B) at the weight ratio (B)/(A) of from 0.01 to 0.5 at the percentage of [(A)+(B)] of from 1 to 30% by weight:

[Component (A)]:

a polyhydric alcohol ester represented by the general formula (I):

$$G[-OH]_p[-(OA)_mOH]_q[-\overset{O}{\overset{\|}{C}}OR]_r[-(OA)_nOC\overset{O}{\overset{\|}{R}}]_s \quad (I)$$

wherein;

G group: a residue obtained by removing all the alcoholic hydroxyl groups from the starting polyhydric alcohol;

[—OH] group, [—$(OA)_m$OH] group, $[-\overset{O}{\overset{\|}{C}}OR]$ group and $[-(OA)_nOC\overset{O}{\overset{\|}{R}}]$ group:

group and each a group binding to group G at the carbon atom to which the hydroxyl groups, which have been removed from the starting polyhydric alcohol, were bonded, wherein A groups may be the same or different and are alkylene groups having 2 to 3 carbon atoms, R group represents a linear or branched alkyl or alkenyl group having from 7 to 23 carbon atoms; and m and n are each a number of from 0 to 100;

p, q, r and s:

each a number of 0 or above and p+q+r+s represents the total number of the alcoholic hydroxyl groups in the starting polyhydric alcohol, provided that neither p+q nor r+s equals 0]; and

[Component (B)]:

a cationized cellulose having a nitrogen atom content determined by the Kjeldahl method of from 0.1 to 4% by weight.

Further scope and applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

It is necessary that this polyhydric alcohol ester (I) of component (A) has at least one hydroxyl group. Such a polyhydric alcohol ester (I) can be obtained by, for example, known synthetic methods (i) to (vi) as will be described hereinbelow. The synthetic methods (i) to (vi) are effected under the production conditions in the prior art.

Synthetic method (i)

wherein G, R, p, q, r and s are each as defined above; and r' and s' represent each a number of 0 or above with the proviso that r' and s' satisfy the requirement: $0<(r'+s')<(p+q+r+s)$.

In synthetic method (i), a polyhydric alcohol is esterified with a fatty acid. The molar ratio of the polyhydric alcohol to the fatty acid may be selected in such a manner that at least one hydroxyl group remains in the resulting polyhydric alcohol ester (I-1), i.e., p does not become 0.

Regarding the esterification conditions, an acidic catalyst such as sulfuric acid, hydrochloric acid and p-toluenesulfonic acid may be used, though the esterification may be effected without using any catalyst.

Examples of the polyhydric alcohol to be used in this case include glycerol, erythritol, pentaerythritol, sorbitol and sorbitan. These polyhydric alcohols may be used either alone or in the form of a mixture of at least two of them.

Examples of the fatty acid to be used in this case include capric acid, lauric acid, myristic acid, palmitic acid, oleic acid, stearic acid, isostearic acid, arachidic acid and behenic acid; and fatty acids obtained from unhardened or hardened animal fats (for example, beef tallow and lard), palm oil, rapeseed oil and fish oil. These fatty acids may be used either alone or in the form of a mixture of at least two of them.

Synthetic method (ii)

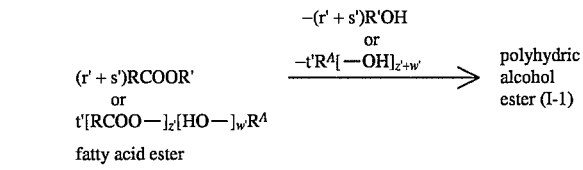

wherein G, R, p, q, r, s, r' and s' are each as defined above; R' represents a residue obtained by removing an alcoholic hydroxyl group from a monohydric alcohol; $R^A$ represents a residue obtained by removing all the alcoholic hydroxyl groups from a polyhydric alcohol; and t', w' and z' represent a number of 1 or above, a number of 0 or above and a positive number, respectively, with the provisos that z'+w' represents the total number of the alcoholic hydroxyl groups in the starting polyhydric alcohol, and that t' and z' satisfy the requirement: $0<(t'\times z')<(p+q+r+s)$.

In synthetic method (ii), a fatty acid ester is transesterified with a polyhydric alcohol. In synthetic method (ii), NaOH, KOH, $NaOCH_3$, $KOCH_3$ or the like is used as a reaction catalyst.

Examples of the fatty acid ester to be used in synthetic method (ii) include esters of methanol, ethanol, propanol, butanol, ethylene glycol, glycerol, erythritol, pentaerythritol, xylitol, sorbitol and sorbitan with the fatty acids described above in the synthetic method (i).

Synthetic method (iii)

polyhydric alcohol ester (I-1) + (m + n) mol of alkylene oxide having 2 or 3 carbon atoms ⟶ polyhydric alcohol ester (I-2)

wherein the polyhydric alcohol ester (I-1) represents a polyhydric alcohol ester obtained by the above synthetic methods (i) or (ii); and m and n are each as defined above.

In synthetic method (iii), an alkylene oxide having 2 or 3 carbon atoms is added to a polyhydric alcohol ester (I-1) obtained by the above synthetic methods (i) or (ii) to thereby give another polyhydric alcohol ester (I-2). In this case, NaOH, KOH, $NaOCH_3$, $KOCH_3$, an alkali metal salt of a fatty acid or the like is used as a reaction catalyst.

In this alkylene oxide addition reaction, the molar ratio of the alkylene oxide to the polyhydric alcohol ester (I-1) ranges from 1/1 to 100/1, preferably from 1/1 to 50/1.

Synthetic method (iv)

polyhydric alcohol ester (I-2) + (r" +s")RCOOH, (r" + s")RCOOR' or t"[RCOO—]$_{z"}$[HO—]$_{w"}$R$^A$ ⟶ (−(r" + s")$H_2O$, −(r" + s") R'OH or −t"R$^A$[—OH]$_{z"+w"}$) ⟶ polyhydric alcohol ester (I-3)

wherein R, R' and R$^A$ are each as defined above; the polyhydric alcohol ester (I-2) represents one obtained by the synthetic method (iii); r" and s" represent each a number of 0 or above with the proviso that r" and s" satisfy the requirement: $0<(r'+s'+r''+s'')<(p+q+r+s)$ or the requirement: $0<(t'\times z'+r''+s'')<(p+q+r+s)$, wherein r', s', t', z', p, q, r and s are each as defined above; and t", w" and z" represent a number of 1 or above, a number of 0 or above and a positive number, respectively, with the provisos that z"+w" represents the total number of the alcoholic hydroxyl groups in the starting polyhydric alcohol, and that t" and z" satisfy the requirement: $0<(r'+s'+t''\times z'')<(p+q+r+s)$ or the requirement: $0<(t'\times z'+t''\times z'')<(p+q+r+s)$, wherein r', s', t', z', p, q, r and s are each as defined above.

In synthetic method (iv), the polyhydric alcohol ester (I-2) obtained by the synthetic method (iii) is reacted with a fatty acid or an ester thereof employed in synthetic methods (i) or (ii) under the same conditions as those employed in synthetic methods (i) or (ii), respectively.

In the reaction mixtures obtained by these methods, unreacted polyhydric alcohol ester, fatty acid or fatty acid ester may be contained in some cases, in addition to the target polyhydric alcohol ester (I), i.e., component (A). In the preparation of the liquid softener composition according to the present invention, the reaction mixture containing also unreacted polyhydric alcohol ester, fatty acid or fatty acid ester may be used as such, so long as the effects of the present invention are not deteriorated thereby.

Synthetic method (v)

G[—OH]$_{p+q+r+s}$ + (r' + s')RCOOR' or t'[RCOO—]$_{z'}$[HO—]$_{w'}$R$^A$ + (m + n) mol of alkylene oxide having 2 or 3 carbon atoms ⟶ polyhydric alcohol ester (I-2)

polyhydric alcohol; fatty acid ester wherein G, R, R", R$^A$, p, q, r, s, r', s', t', z', w', m and n are each as defined above.

In synthetic method (v), the molar ratio of the fatty acid ester to the polyhydric alcohol may be selected in such a manner that the hydroxyl group remains in the resulting polyhydric alcohol ester (I-2), i.e., p+q does not become 0. The molar ratio of the alkylene oxide to the polyhydric alcohol ranges from 1/1 to 100/1, preferably from 5/1 to 50/1.

The catalyst to be used in this synthetic method may be the same as the one employed in synthetic method (iii).

Synthetic method (vi)

G[—OH]$_{p+q+r+s}$ + (m + n) mol of alkylene oxide having 2 or 3 carbon atoms ⟶ alkylene oxide adduct of polyhydride alcohol ⟶ (+(r'+s')RCOOH, −(r' + s')$H_2O$) ⟶ polyhydric alcohol ester (I-2)

polyhydric alcohol wherein G, R, p, q, r, s, r', s', m and n are each as defined above.

In synthetic method (vi), an alkylene oxide is added to a polyhydric alcohol [according to the same reaction conditions as those employed in the above method (iii)] to give an alkylene oxide adduct of the polyhydric alcohol. The obtained product is then esterified with a fatty acid [according to the same reaction conditions as those employed in the above method (i) ].

Examples of the polyhydric alcohol esters (I) obtained by the above synthetic methods (i) to (vi) and the like way include those shown below. These esters may be used either alone or in the form of a mixture of at least two of them.

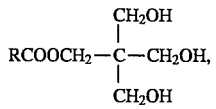

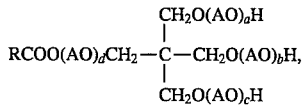

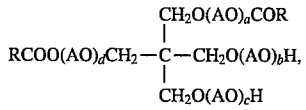

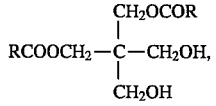

-continued

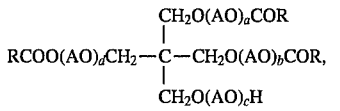

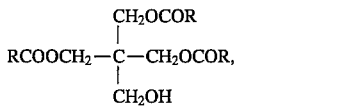

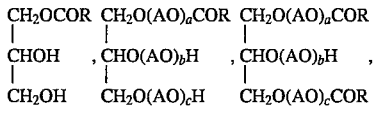

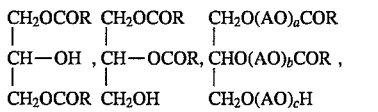

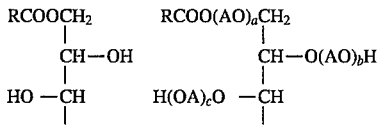

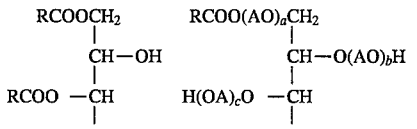

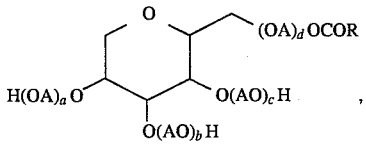

, and

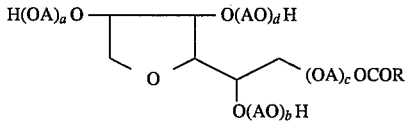

wherein R and A are each as defined above; and a, b, c, d, e and f represent each the number of moles of an added alkylene oxide having 2 or 3 carbon atoms.

In the above formulas showing the polyhydric alcohol esters (I), the total number of moles of added alkylene oxide is usually from 0 to 200 and preferably from 0 to 40.

In the present invention, a cationized cellulose is used as component (B). The cationized cellulose to be used in the present invention is a water-soluble polymer which contains a quaternary nitrogen atom, i.e., a quaternary ammonium part, and has anhydrous glucose as its constituent unit. Examples of the cationized cellulose include those represented by the following formula (II):

$$E[-OH]_x[-OY]_g[-OZ]_h \qquad \text{(II)}$$

wherein

E represents a residue obtained by removing all the alcoholic hydroxyl groups from the cellulose; the [—OH], [—OY] and [—OZ] groups represent each a group binding to E at the site of the removed hydroxyl group, wherein Y represents a group containing a quaternary nitrogen atom, and Z represents a substituent free from quaternary nitrogen atoms and having 1 to 10 carbon atoms in total; and x, g and h are each a number of 0 or above with the provisos that x+g+h represents the total number of alcoholic hydroxyl groups in the starting cellulose and that g is selected so that the nitrogen content in the cationized cellulose molecule is from 0.1 to 4% by weight, determined by the Kjeldahl method.

The cationized cellulose to be used in the present invention has a content, determined by the Kjeldahl method, of nitrogen contained in cationized cellulose molecule (hereinafter referred to simply as "nitrogen content") ranging from 0.1 to 4% by weight, preferably from 0.5 to 3.5% by weight and still more preferably from 1 to 3% by weight. It is necessary to use a cationized cellulose having a nitrogen content of within the above-described range in order to achieve the object of the present invention. When a cationized cellulose having a nitrogen content outside of the range of from 0.1 to 4% by weight is used, the obtained liquid softener composition cannot achieve the desired softening effect of the present invention.

The process for producing the cationized cellulose to be used in the present invention is not restricted. For example, it can be produced by the processes described in U.S. Pat. No. 3,472,840 (assignee: UNION CARBIDE CORP.), and Japanese Patent Publication-A Nos. 56-62,801 (published on May 29, 1981) and 53-90,368 (published on Aug. 9, 1978).

Examples of Y in the above formula (II) include the following groups:

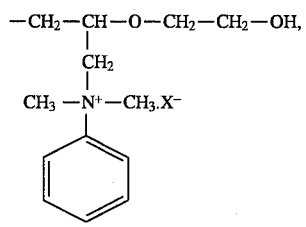

-continued
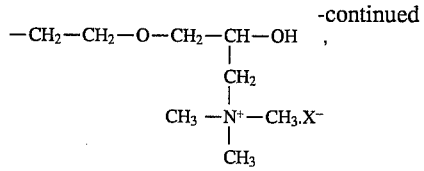
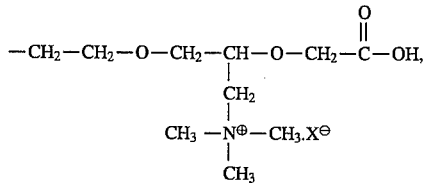
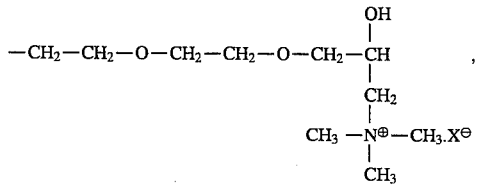
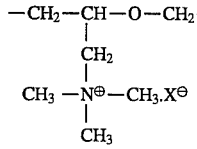
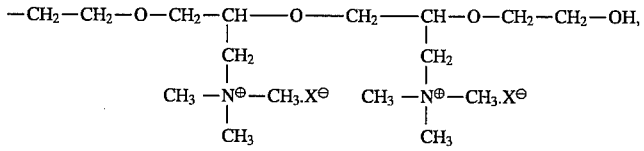
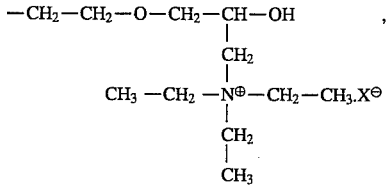
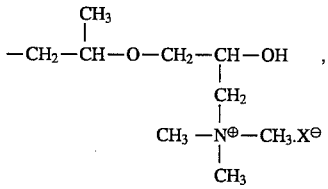
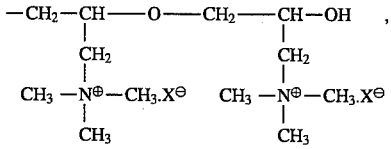
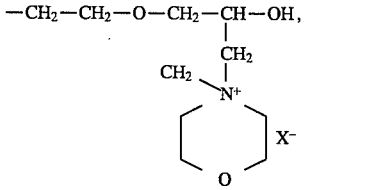

-continued

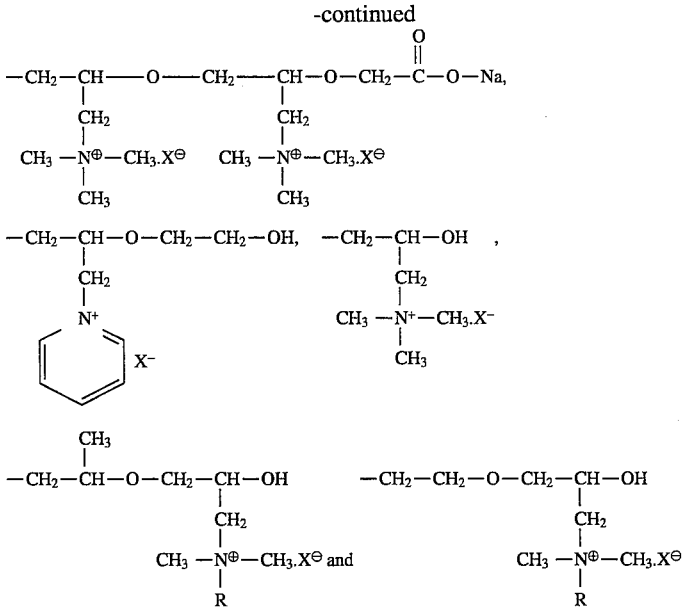

wherein $X^-$ represents an anion such as $Cl^-$, $Br^-$, $NO_3^-$, $1/2SO_4^{2-}$ and $CH_3SO_4^-$; and R is as defined above.

Examples of Z in the above formula (II) include the following groups:

$$-CH_3,\ -CH_2CH_3,\ -CH_2CH_2OH,\ -CH_2-\overset{CH_3}{\overset{|}{C}}H-OH,$$

$$-CH_2CH_2OCH_2CH_2OH,\ -CH_2COOH,\ -CH_2COOM,$$

$$-CH_2CH_2OCH_2CH_2OCH_2CH_2OH \text{ and } -CH_2CH_2OCH_2\overset{O}{\overset{\|}{C}}OM$$

wherein M represents an alkali metal such as Na, K and Li.

Preferable examples of the cationized cellulose as component (B) include those represented by the formula (II) wherein E represents a residue obtained by removing all of the alcoholic hydroxyl groups from a cellulose having a molecular weight of 200,000 to 300,000, Y represents

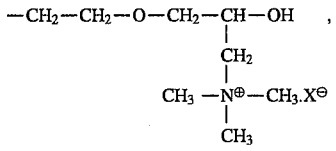

wherein X is as defined above, and z represents $-CH_2CH_2OH$ and/or $-CH_2CH_2OCH_2CH_2OH$.

Particular examples of the cationized cellulose represented by the formula (II) include JR-125, JR-400 and JR-30M (trademarks, manufactured by Union Carbide Japan), Catinal HC-100, Catinal HC-200, Catinal LC-100 and Catinal LC-200 (trademarks, manufactured by Toho Chemical Industry, Co., Ltd.), NK Polymer (RE) (a trademark, manufactured by Nitto Chemical Industry Co., Ltd.) and Jellner QL100 (a trademark, manufactured by Diacel Chemical Industries, Ltd.)

To achieve the object of the present invention, it is preferable to use a cationized cellulose of which 2 wt. % aqueous solution has a viscosity of from 20 to 5,000 cps, still more preferably from 75 to 2,000 cps in the present invention, when measured with a Brookfield viscometer at 30° C. (use is made of rotors No. 2, 3 or 4 depending on the viscosity; revolution rate: 60 rpm).

The liquid softener composition of the present invention can be obtained by dissolving or dispersing the essential components (A) and (B) in water.

The weight ratio of component (B) to component (A) [component ((B)/component (A)] in the liquid softener composition of the present invention ranges from 0.01 to 0.5, preferably from 0.1 to 0.4. When this ratio is outside the range of from 0.01 to 0.5, the resulting liquid softener composition cannot achieve the softening effect desired in the present invention.

In the liquid softener composition of the present invention, the total content of the components (A) and (B) ranges from 1 to 30% by weight, preferably from 3 to 20% by weight. When the total content of the components (A) and (B) in the composition is less than 1% by weight, too much softener composition would be required to be added in a single loading deteriorating the handleability of the composition. When this total content exceeds 30% by weight, the viscosity of the softener composition is elevated, which causes difficulty in removing the softener composition from the bottle during use.

In addition to the components (A) and (B), the softener composition of the present invention may further contain a nonionic surfactant such as a polyoxyalkylene alkyl ether represented by the formula (III), a polyoxyalkylene N-alkyldiethanolamide represented by the formula (IV), a polyoxyalkylene N-alkyldiethanolamine represented by the formula (V), and mixtures thereof:

$$R''O(AO)_iH \qquad \text{(III)}$$

wherein R" represents an alkyl group having 8 to 24 carbon atoms; i is a number of from 10 to 100; and A is as defined above,

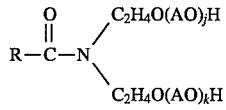

(IV)

wherein R and A are each as defined above; and j and k are each a number of 0 or higher, provided that j+k is a number of from 0 to 98, and

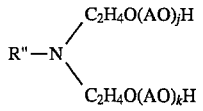

(V)

wherein R", A, j and k are each as defined above.

By using the nonionic surfactant together with the above-mentioned components (A) and (B), the component (A) can be smoothly dispersed in the preparation of the softener composition of the present invention. The amount of the nonionic surfactant ranges from 1 to 100% by weight, preferably from 10 to 40% by weight, based on the amount of the component (A).

The liquid softener composition of the present invention may furthermore contain a fragrance, a coloring, a silicone compound, an antibacterial agent, a solvent, such as isopropyl alcohol, ethylene glycol and propylene glycol, and/or a water soluble salt such as sodium chloride, ammonium chloride, calcium chloride and aluminum chloride which have been commonly used in the softener compositions for clothes.

In order to further improve the dispersibility of the components (A) and/or (B) in water, the liquid softener composition of the present invention may also contain, for example, urea, an urea derivative (methylurea or ethylurea) or p-toluenesulfonic acid. The amount thereof may be from 0 to 10% by weight based on the total weight of the composition according to the present invention.

Component (A), component (B), and other components may be blended in an arbitrary order in the preparation of the liquid softener composition of the present invention. In general, component (A) which is maintained at a temperature higher than the melting point or the softening point thereof is poured into water or an aqueous solution of the above-mentioned nonionic surfactant which is maintained at 50° to 80° C., while stirring. Then, an aqueous solution of component (B) is added thereto, while stirring. After continuing the stirring, the resulting mixture is cooled. Thus, the liquid softener composition of the present invention can be prepared.

The softener composition of the present invention makes it possible to efficiently impart a softness to both natural and synthetic fibers without giving any greasy feeling to the fibers or to the fabric made therefrom to be treated with the softener composition.

EXAMPLES

The present invention will now be described in more detail with reference to the following Examples which should not be considered to limit the scope of the present invention.

Examples 1 to 24 and Comparative Examples 1 to 6

By using the components (A) as specified in Table 1 and the components (B) as specified in Table 2, liquid softener compositions listed in Tables 3 to 5 were obtained. Each composition was prepared by heating water or an aqueous solution which is obtained by dissolving the component (nonionic surfactants, etc.) as specified in the column headed "Other component" in Tables 3 to 5 in water, pouring the component (A), maintained at a temperature higher than the melting point or the softening point thereof, into the water or the aqueous solution which was maintained at 50° to 80° C. while stirring, adding an aqueous solution of the component (B) thereto while stirring, continuing the stirring of the resultant mixture, and then cooling.

The liquid softener compositions thus obtained were employed to treat towels and other fabrics. The towels and other fabrics treated were evaluated in the following areas. Tables 3 to 5 also summarize the results of this evaluation.

[Evaluation method of softness and greasy feeling]

Marketed cotton towels, cloths made of acrylic fibers and cloths made of polyester fibers were repeatedly washed with a marketed detergent "Attack" (a registered trademark, manufactured by Kao Corporation) 5 times. Each liquid softener composition prepared above was diluted with water (hard water of DH 3.5°) to prepare a 0.1% by weight (in terms of the active ingredient, i.e., the total content of components (A) and (B) in the aqueous solution is 0.1% by weight) of an aqueous solution thereof. The washed and rinsed cotton towels, cloths made of acrylic fibers and cloths made of polyester fibers were immersed in each aqueous solution of the liquid softener composition prepared above at 25° C. at a bath ratio of 1/30 for 1 minute under stirring, as a softening treatment. The treated cotton towels, cloths made of acrylic fibers and cloths made of polyester fibers were air-dried in a room, and then they were allowed to stand in a thermohygrostat (20° C., 65% RH) for 24 hours.

Then, the softness and greasy feeling of these towels and cloths were evaluated.

The softness and greasy feeling were evaluated by the paired comparison test with the use of, as a control, a towel and a cloth, respectively, which had been treated with an aqueous solution of di(hardened beef tallow)dimethylammonium chloride (5% by weight) (Comparative Example 10).

The evaluation scores have the following meanings.

Softness:

+2: softer than the control,

+1: somewhat softer than the control,

0: as soft as the control,

−1: somewhat harder than the control, and

−2: harder than the control.

Greasy feeling:

+2: less greasy than the control,

+1: somewhat less greasy than the control,

0: as greasy as the control,

−1: somewhat greasier than the control, and

−2: greasier than the control.

TABLE 1

| Symbol | Component (A) |
|---|---|
| A-1 | pentaerythritol mono-, di-, tristearate*1 |
| A-2 | glycerol mono-, distearate*2 |
| A-3 | glycerol monostearate*3 |
| A-4 | sorbitan monostearate*4 |
| A-5 | ethylene oxide adduct of A-2*5 (average no. of moles of addition = 5) |
| A-6 | ethylene oxide adduct of A-2*6 (average no. of moles of addition = 40) |
| A-7 | ethylene oxide adduct of glycerol stearate obtained by synthetic method (v)*7 (average no. of moles of addition = 20) |
| A-8 | product obtained by further esterifying A-7 with stearic acid in equimolar amount with glycerol used for obtaining A-7*8 |

TABLE 1-continued

| Symbol | Component (A) |
|---|---|
| A-9 | ethylene oxide adduct of glycerol stearate obtained by synthetic method (vi)*9 (average mo. of moles of addition = 10) |

Note)
*1: Composition by weight of fatty acid esters (%): (monoester)/(diester)/(triester)/(tetraester) = 30/40/25/5.
*2: Composition by weight of fatty acid esters (%): (monoester)/(diester)/(triester) = 60/35/5.
*3: Composition by weight of fatty acid esters (%): (monoester)/(diester) = 97/3.
*4: Rheodol SP-SLO (registered trademark, mfd. by Kao Corporation).
*5: A product obtained by adding 1% by mol, based on the amount of A-2, of NaOH to A-2 and effecting an ethylene oxide addition reaction at 150° C., 3 atm (gauge pressure) for 1 hour.

TABLE 1-continued

| Symbol | Component (A) |
|---|---|

*6: A product obtained by the same procedure as that of *5, except for effecting the ethylene oxide addition reaction for 6 hours.
*7: A product obtained by feeding glycerol and glycerol tristearate at a molar ratio of 1/1, adding 1% by mol, based on the amount of glycerol, of NaOH and effecting an ethylene oxide addition reaction at 150° C., 3 atm (gauge pressure) for 5 hours.
*8: A product obtained by adding 1% by mol, based on the amount of A-7, of $H_2SO_4$ to A-7, adding stearic acid in equimolar amount with the starting glycerol and esterifying at 200° C. for 2 hours.
*9: A product obtained by adding 1% by mol, based on the amount of glycerol, of sodium stearate to glycerol, effecting an ethylene oxide addition reaction at 150° C., 3 atm (gauge pressure) for 3 hours, adding to the reaction product stearic acid in the equimolar amount with the starting glycerol and 1% by mol, based on the starting glycerol, of $H_2SO_4$, and esterifying at 200° C. for 3 hours.

TABLE 2

| Symbol | Component (B) | N content*1 (wt. %) | Viscosity*2 (Cps) |
|---|---|---|---|
| B-1 | JR-125 (trademark, mfd. by Union Carbide, Japan) | 2.0 | 100 |
| B-2 | JR-400 (trademark, mfd. by Union Carbide, Japan) | 2.0 | 350 |
| B-3 | JR-30M (trademark, mfd. by Union Carbide, Japan) | 2.0 | 1200 |
| B-4 | Catinal HC-100 (trademark, mfd. by Toho Chemical Industry, Co., Ltd.) | 1.2 | 350 |
| B-5 | Catinal HC-200 (trademark, mfd. by Toho Chemical Industry, Co., Ltd.) | 1.5 | 1200 |
| B-6 | Catinal LC-100 (trademark, mfd. by Toho Chemical Industry, Co., Ltd.) | 0.8 | 550 |
| B-7 | Catinal LC-200 (trademark, mfd. by Toho Chemical Industry, Go., Ltd.) | 1.0 | 1800 |
| B-8 | NK Polymer (RE) (trademark, mfd. by Nitto Chemical Industry, Co., Ltd.) | 1.8 | 300 |
| B-9 | Jellner QL100 (trademark, mfd. by Daicel Chemical Industries, Ltd.) | 0.5 | 350 |
| B-10 | Product obtained by cationizing Hydroxyethylmethylcellulose SEW-04T (trademark, mfd. by Shin-Etsu Chemical Co., Ltd.) with glycidyl-trimethylammonium chloride by the method*3 of Example 4 in Japanese Patent Publication-A No. 5-70,501 (published on March 23, 1993) | 3.2 | 5000 |
| B-11 | HEC Daicel SP500 (trademark, mfd. by Daicel Chemical Industries, Ltd.) | 0 | 350 |

*1: Determined by the Kjeldahl method.
*2: Determined the viscosity of a 2 wt. % aqueous solution of component (B) at 30° C. by using a Brookfield viscometer at a revolution rate of the rotor of 60 rpm. Rotors No. 2, No. 3 and No. 4 were employed respectively at the viscosities of the aqueous solution of component (B) of less than 500 cps, 500 to 2,000 cps and 2,000 to 10,000 Cps.
*3: This method is described in Japanese Patent Publication-A No. 5-70,501 as Example 4. Its description is as follows:
200 g of hydroxyethylmethylcellulose SEW-04T (trademark, mfd. by Shin-Etsu Chemical Co., Ltd., viscosity of 2% aqueous solution thereof at 20° C.: 4,660cps, molar number of hydroxyethyl group as the substituent per glucose unit: 0.36, molar number of methyl group as the substituent per glucose unit: 1.40)
was dispersed in 2,000 g of t-butanol, followed by the addition of an aqueous causic soda solution, which had been prepared by adding 8.10 g (0.2 mol per glucose unit of the starting cellulose ether) of causic soda to 540 g of water at room temperature. Then, 159.3 g (1.0 mol per glucose unit of the starting cellulose ether) of glycidyltrimethylammonium chloride were added to the resultant mixture.
The obtained mixture was stirred at 50° C. for 5 hours, followed by the addition of 12.8 g of 30% aqueous acetic acid solution to neutralize. After cooling the reaction mixture (slurry) to room temperature, the slurry was filtered. The filter cake thus obtained was washed with an aceton/water mixture (90/10) four times, and then dried with a vacuum desiceator to be a constant weight.
Thus, 281 g of a cationized hydroxyethylmethylcellulose was obtained. The nitrogen content thereof, determined by the Kjeldahl method, was 3.24 %, the molar number of the cationic group as the substituent per glucose unit was 0.72, and the rate of effective utilization of the agent for cationization was 72%.

TABLE 3

| Example No. | Component (A) | Component (B) | Other component | Softness | Greasy feeling |
|---|---|---|---|---|---|
| 1 | A-1 (5) | B-1 (2.5) | polyoxyethylene (20 mol) lauryl ether (1) | 0 | +2 |
| 2 | A-1 (5) | B-1 (0.05) | polyoxyethylene (20 mol) lauryl ether (1) | 0 | +2 |
| 3 | A-1 (29) | B-1 (1) | polyoxyethylene (20 mol) lauryl ether (10) | +1 | +2 |
| 4 | A-1 (0.9) | B-1 (0.1) | polyoxyethylene (20 mol) lauryl ether (0.1) | +2 | +2 |
| 5 | A-1 (0.9) | B-1 (0.1) | – | +1 | +2 |
| 6 | A-1 (5) | B-1 (1) | diethylene glycol lauryl ether (1) | +2 | +2 |
| 7 | A-1 (5) | B-1 (1) | polyoxyethylene (20 mol) lauryl ether (1) | +2 | +2 |
| 8 | A-2 (5) | B-1 (1) | polyoxyethylene (20 mol) lauryl ether (1) | +2 | +2 |
| 9 | A-3 (5) | B-1 (1) | polyoxyethylene (20 mol) lauryl ether (1) | +1 | +2 |
| 10 | A-4 (5) | B-1 (1) | polyoxyethylene (20 mol) lauryl ether (1) | +2 | +2 |
| 11 | A-5 (5) | B-1 (1) | polyoxyethylene (20 mol) lauryl ether (1) | +2 | +2 |
| 12 | A-6 (5) | B-1 (1) | polyoxyethylene (20 mol) lauryl ether (1) | +1 | +2 |
| 13 | A-7 (5) | B-1 (1) | polyoxyethylene (20 mol) lauryl ether (1) | +1 | +2 |
| 14 | A-8 (5) | B-1 (1) | polyoxyethylene (20 mol) lauryl ether (1) | +2 | +2 |

Note)
In each column of each component, figures in the parentheses refer to the content (% by weight) based on the total amount of the composition of the corresponding component (the same will apply hereinafter).
Each composition contains water in addition to the components described in the table in an amount of the balance to 100% (the same will apply hereinafter).

TABLE 4

| Example No. | Component (A) | Component (B) | Other component | Softness | Greasy feeling |
|---|---|---|---|---|---|
| 15 | A-9 (5) | B-1 (1) | polyoxyethylene (20 mol) lauryl ether (1) | +2 | +2 |
| 16 | A-1 (5) | B-2 (1) | polyoxyethylene (20 mol) lauryl ettrer (1) | +2 | +2 |
| 17 | A-1 (5) | B-3 (0.5) | polyoxyethylene (20 mol) lauryl ether (1) | +2 | +2 |
| 18 | A-1 (5) | B-4 (1) | polyoxyethylene (20 mol) lauryl ether (1) | +2 | +2 |
| 19 | A-1 (5) | B-5 (0.5) | polyoxyethylene (20 mol) lauryl ether (1) | +2 | +2 |
| 20 | A-1 (5) | B-6 (1) | polyoxyethylene (20 mol) lauryl ether (1) | +2 | +2 |
| 21 | A-1 (3) | B-7 (0.5) | polyoxyethylene (20 mol) lauryl ether (1) | +2 | +2 |
| 22 | A-1 (5) | B-8 (1) | polyoxyethylene (20 mol) lauryl ether (1) | +2 | +2 |
| 23 | A-1 (5) | B-9 (1) | polyoxyethylene (20 mol) lauryl ether (1) | +1 | +2 |
| 24 | A-1 (5) | B-10 (0.1) | polyoxyethylene (20 mol) lauryl ether (1) | +1 | +2 |

TABLE 5

| Comparative Example No. | Component (A) | Component (B) | Other component | Softness | Greasy feeling |
|---|---|---|---|---|---|
| 1 | A-1 | — | — | −2 | +2 |

TABLE 5-continued

| Comparative Example No. | Component (A) | Component (B) | Other component | Softness | Greasy feeling |
|---|---|---|---|---|---|
| | (1) | | | | |
| 2 | — | B-1 (1) | — | −2 | +2 |
| 3 | A-1 (5) | B-1 (5) | polyoxyethylene (20 mol) lauryl ether (1) | −1 | +2 |
| 4 | A-1 (5) | B-1 (0.005) | polyoxyethylene (20 mol) lauryl ether (1) | −2 | +2 |
| 5 | A-1 (5) | B-11 (1) | polyoxyethylene (20 mol) lauryl ether (1) | −1 | +2 |
| 6 | A-1 (5) | — | di (hardened beef tallow) dimethylammonium chloride (1) | 0 | +1 |
| 7 | — | B-1 (1) | polyoxyethylene (20 mol) stearyl ether (1) | −2 | +1 |
| 8 | — | B-1 (1) | glycerol (5) | −2 | +1 |
| 9 | A-1 (5) | — | N-tallow-diethanolamide (1) diethylene glycol lauryl ether (1) 30% HCl (0.08) | −1 | +1 |
| 10* | — | — | di (hardened beef tallow) dimethylammonium chloride (5) | 0 | 0 |

Note)
*: Comparative Example 10 was used as a control.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A liquid softener composition, comprising:

(A) a polyhydric alcohol ester represented by the formula (I)

$$G(-OH)_p(-(OA)_mOH)_q(-\overset{O}{\overset{\|}{C}}R)_r(-(OA)_n\overset{O}{\overset{\|}{C}}R)_s \quad (I)$$

wherein

G represents a residue obtained by removing all alcoholic hydroxyl groups from a polyhydric alcohol;

(the $(-OH)$, $(-(OA)_mOH)$, $(-\overset{O}{\overset{\|}{C}}R)$ and $(-(OA)_n\overset{O}{\overset{\|}{C}}R)$ groups each bind to G at a removed alcoholic hydroxyl group, wherein A represents an alkylene group having 2 or 3 carbon atoms, each alkylene group being the same or different from one another, R represents a linear or branched alkyl or alkenyl group having 7 to 23 carbon atoms, each alkyl or alkenyl group being the same or different from one another, and m and n are each a number of from 0 to 100; and p, q, r and s each represent a number of 0 or higher, with the provisos that p+q+r+s represents the total number of the alcoholic hydroxyl groups in G and that neither p+q nor r+s equals 0; and (B) a cationized cellulose having a nitrogen content of from 0.1 to 4% by weight as determined by the Kjeldahl method;

wherein the weight ratio of (B) to (A) ranges from 0.01 to 0.5 and the total content of (A) and (B) ranges from 1 to 30% by weight, based on the total weight of the composition.

2. The liquid softener composition as claimed in claim 1, wherein the polyhydric alcohol ester comprises at least one compound selected from the group consisting of:

(a-1) a pentaerythritol/fatty acid ester having at least one hydroxyl group;

(a-2) a $C_2$ or $C_3$ alkylene oxide adduct of a pentaerythritol/fatty acid ester having at least one hydroxyl group;

(b-1) a glycerol/fatty acid ester having at least one hydroxyl group;

(b-2) a $C_2$ or $C_3$ alkylene oxide adduct of a glycerol/fatty acid ester having at least one hydroxyl group;

(c-1) a sorbitol/fatty acid ester having at least one hydroxyl group; and (c-2) a $C_2$ or $C_3$ alkylene oxide adduct of a sorbitol/fatty acid ester having at least one hydroxyl group.

3. The liquid softener composition as claimed in claim 1, wherein the polyhydric alcohol ester comprises a pentaerythritol/fatty acid ester having at least one hydroxyl group.

4. The liquid softener composition as claimed in claim 1, wherein the polyhydric alcohol ester comprises a $C_2$ or $C_3$ alkylene oxide adduct of a pentaerythritol/fatty acid ester having at least one hydroxyl group.

5. The liquid softener composition as claimed in claim 1, wherein the polyhydric alcohol ester comprises a glycerol/fatty acid ester having at least one hydroxyl group.

6. The liquid softener composition as claimed in claim 1, wherein the polyhydric alcohol ester comprises a $C_2$ or $C_3$ alkylene oxide adduct of a glycerol/fatty acid ester having at least one hydroxyl group.

7. The liquid softener composition as claimed in claim 1, wherein the polyhydric alcohol ester comprises a sorbitol/fatty acid ester having at least one hydroxyl group.

8. The liquid softener composition as claimed in claim 1, wherein the polyhydric alcohol ester comprises a $C_2$ or $C_3$ alkylene oxide adduct of a sorbitol/fatty acid ester having at least one hydroxyl group.

9. The liquid softener composition as claimed in claim 1, wherein the polyhydric alcohol ester comprises one member selected from the group consisting of

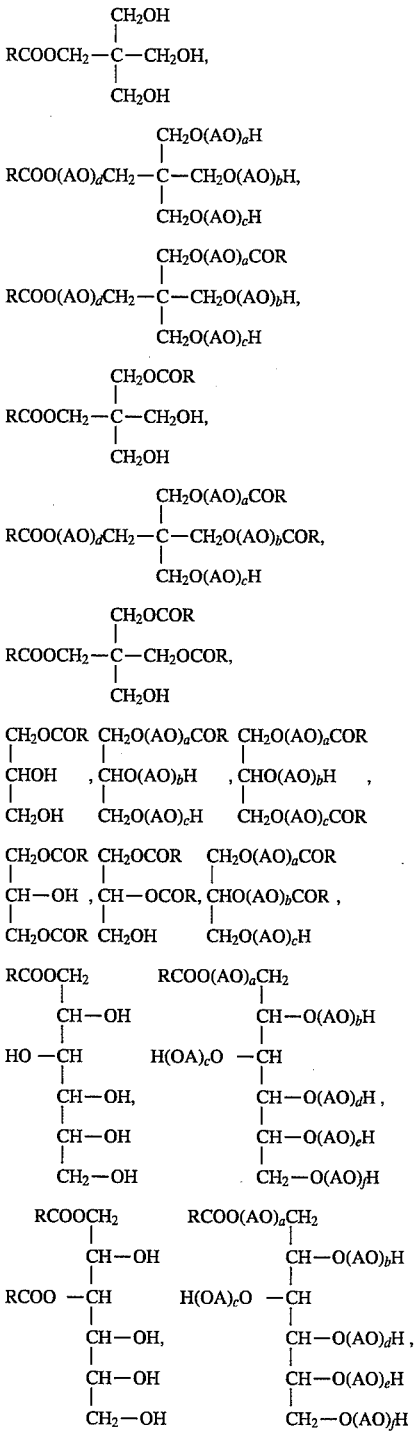

-continued

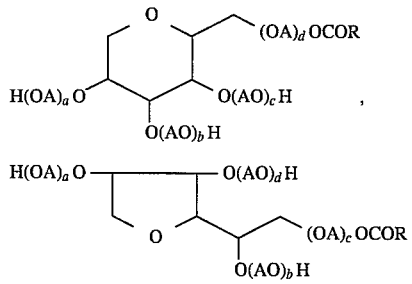

and mixtures thereof, wherein R and A are each as defined in claim 1; and a, b, c, d, e and f represent each the number of moles of added alkylene oxide having 2 or 3 carbon atoms.

10. The liquid softener composition as claimed in claim 1, wherein the polyhydric alcohol ester has 2 to 10 alcoholic hydroxyl groups.

11. The liquid softener composition as claimed in claim 1, wherein the polyhydric alcohol ester has 3 to 6 alcoholic hydroxyl groups.

12. The liquid softener composition as claimed in claim 1, wherein:

the cationized cellulose is represented by the formula (II)

$$E(-OH)_x(-OY)_g(-OZ)_h \quad \text{(II)}$$

wherein

E represents a cellulose residue obtained by removing all alcoholic hydroxyl groups from a starting cellulose;

the (—OH), (—OY) and (—OZ) groups each represent a group binding to E at a removed hydroxyl group, wherein Y represents a group containing a quaternary nitrogen atom, and Z represents a $C_1$–$C_{10}$ alkyl, $C_1$–$C_{10}$ alkoxy alkyl, $C_1$–$C_{10}$ polyoxalkylene alkyl all of which may be substituted with a hydroxyl or a carboxyl group and free from quaternary nitrogen atoms; and x, g and h are each a number of 0 or above with the provisos that x+g+h represents the total number of the alcoholic hydroxyl groups in the starting cellulose, and that g is selected so that the nitrogen content of the cationized cellulose is from 0.1 to 4% by weight, determined by the Kjeldahl method.

13. The liquid softener composition as claimed in claim 1, wherein the cationized cellulose has a nitrogen content of from 0.5 to 3.5% by weight, determined by the Kjeldahl method.

14. The liquid softener composition as claimed in claim 1, wherein the cationized cellulose has a nitrogen content of from 1 to 3% by weight, determined by the Kjeldahl method.

15. The liquid softener composition as claimed in claim 12, wherein Y is selected from the group consisting of:

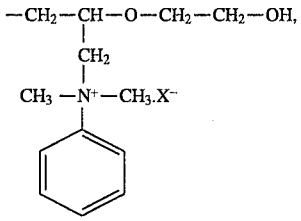
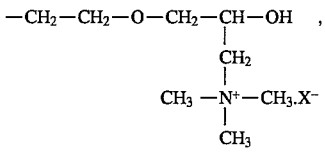
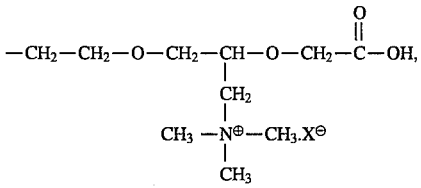
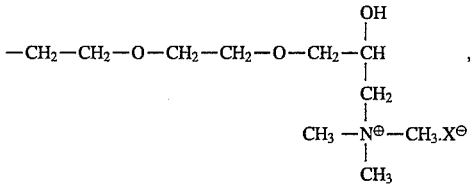
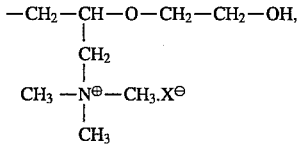
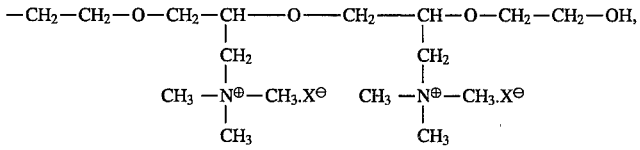
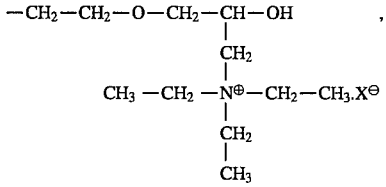
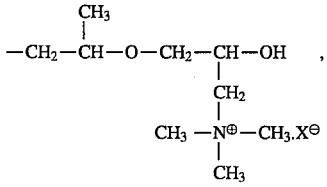
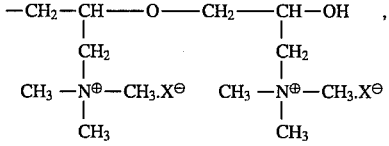

-continued

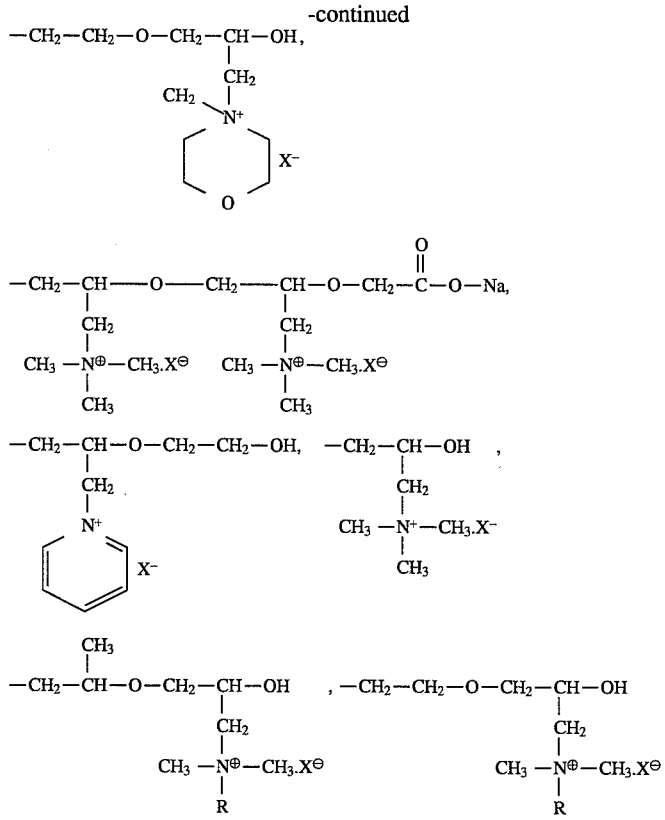

and mixtures thereof, wherein $X^-$ represents an anion selected from the group consisting of $Cl^-$, $Br^-$, $NO_3^-$, $1/2SO_4^{2-}$ and $CH_3SO_4^-$ and wherein R is as defined in claim 12.

16. The liquid softener composition as claimed in claim 12, wherein Z is selected from the group consisting of:

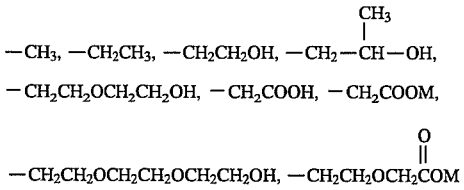

and mixtures thereof, wherein M represents an alkali metal.

17. The liquid softener composition as claimed in claim 12, wherein E represents a cellulose residue obtained by removing all alcoholic hydroxyl groups from a cellulose having a molecular weight of 200,000 to 300,000, Y represents

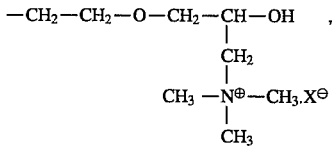

wherein X is selected from the group consisting of $Cl^-$, $Br^-$, $NO_3^-$, $1/2SO_4^{2-}$ and $CH_3SO_4^-$ and Z represents $—CH_2CH_2OH$, $—CH_2CH_2OCH_2CH_2OH$ or a mixture of $—CH_2CH_2OH$ and $—CH_2CH_2OCH_2CH_2OH$.

18. The liquid softener composition as claimed in claim 1, which further comprises 1 to 100% by weight of a nonionic surfactant based on the amount of component (A).

19. The liquid softener composition as claimed in claim 1, which further comprises a fragrance a coloring, a silicone compound, an antibacterial agent, a solvent, a water soluble salt, or a combination thereof.

20. The liquid softener composition as claimed in claim 1, which further comprises up to 10% by weight urea, methylurea, ethylurea or P-toluenesulfonic acid based on the total weight of the composition.

* * * * *